US007665722B2

(12) United States Patent
Edinger

(10) Patent No.: US 7,665,722 B2
(45) Date of Patent: Feb. 23, 2010

(54) METHOD AND APPARATUS FOR GUIDING SHEETS TO A SHEET PROCESSING MACHINE, IN PARTICULAR A PRINTING PRESS

(75) Inventor: Holger Edinger, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 489 days.

(21) Appl. No.: 10/799,098

(22) Filed: Mar. 12, 2004

(65) Prior Publication Data

US 2004/0178567 A1 Sep. 16, 2004

(30) Foreign Application Priority Data

Mar. 12, 2003 (DE) ..... 103 10 687

(51) Int. Cl.
*B65H 5/08* (2006.01)

(52) U.S. Cl. ..... 271/11; 271/97

(58) Field of Classification Search ..... 271/11, 271/97, 98, 229, 245, 246, 283, 183
See application file for complete search history.

(56) References Cited

U.S. PATENT DOCUMENTS 2,214,088 A * 9/1940 Seybold ..... 101/279
3,136,539 A * 6/1964 Lyman ..... 271/97
3,236,517 A * 2/1966 Lyman ..... 271/5
3,243,181 A * 3/1966 Lyman ..... 271/279
3,556,519 A * 1/1971 Keller et al. ..... 271/177
3,624,807 A * 11/1971 Schwebel ..... 271/236
3,831,930 A * 8/1974 Shimizu ..... 271/91
3,836,139 A * 9/1974 Shimizu ..... 271/95
3,938,800 A * 2/1976 Wirz ..... 271/93
4,522,388 A * 6/1985 Heine et al. ..... 271/245
4,886,261 A * 12/1989 Jeschke ..... 271/11
5,092,578 A * 3/1992 Bergmeier et al. ..... 271/97
5,234,207 A * 8/1993 Lindstrom et al. ..... 271/11
5,636,833 A 6/1997 Maier et al.
6,016,747 A 1/2000 Beduhn et al.
6,863,272 B2 * 3/2005 DiNatale et al. ..... 271/97
2005/0035537 A1 * 2/2005 Hahn et al. ..... 271/237

FOREIGN PATENT DOCUMENTS

DE 24 58 058 A1 6/1976
DE 44 13 089 C2 10/1995

* cited by examiner

*Primary Examiner*—Patrick H Mackey
*Assistant Examiner*—Thomas A Morrison
(74) *Attorney, Agent, or Firm*—Laurence A. Greenberg; Werner H. Stemer; Ralph E. Locher

(57) ABSTRACT

In a method and an apparatus for guiding sheets to a sheet processing machines, provision is made to reduce the adhesion forces between sheets following one another by the trailing edge of the respective first sheet of a sheet stream being lifted. The sheet is lifted using a blowing/suction nozzle or a suction nozzle.

12 Claims, 4 Drawing Sheets

METHOD AND APPARATUS FOR GUIDING SHEETS TO A SHEET PROCESSING MACHINE, IN PARTICULAR A PRINTING PRESS

BACKGROUND OF THE INVENTION

Field of the Invention

The invention relates to a method and an apparatus for guiding sheets to a sheet processing machine, in particular a printing press.

In particular during the processing of sheets with a smooth surface, such as coated paper, coated sheets or films, there is the problem that the sheets in the overlapping stream adhere to one another as a result of adhesion forces. This leads to the situation in which, when the first aligned sheet is pulled off, the respective second sheet is carried along with it and, when the overlap is pushed together during the alignment of the first sheet, the second sheet is displaced with it, which leads to erroneous sheet transport and to a stoppage of the sheet processing machine.

German Patent DE 44 13 089 C2, corresponding to U.S. Pat. No. 5,636,833, provides for blown air to be blown continuously under the sheet stream from below, in order in this way to reduce the adhesion forces between two sheets following one another. However, the blown air under the sheet stream disturbs the uniform guidance of the sheets.

SUMMARY OF THE INVENTION

It is accordingly an object of the invention to provide a method and an apparatus for guiding sheets to a sheet processing machine that overcome the above-mentioned disadvantages of the prior art methods and devices of this general type, with which the adhesion forces between the sheets of a sheet stream can be reduced effectively.

With the foregoing and other objects in view there is provided, in accordance with the invention, a method for guiding sheets to a sheet processing machine. The method includes reducing an adhesion force between two sheets following one another in an overlapping stream by lifting a sheet trailing edge of a first sheet. The sheet trailing edge of the first sheet is lifted by blowing a medium under from the rear. The first sheet is aligned in a sheet transport direction before the sheet trailing edge of the first sheet is lifted. Additionally, the first sheet can be aligned laterally at the same time as the sheet trailing edge of the first sheet is lifted. Specifically, the first sheet can be laterally aligned after the sheet trailing edge of the first sheet has been lifted.

It is a particular advantage of the invention that the cancellation of the adhesion forces between sheets lying on one another or following one another is initiated by a separation measure which acts on the overlapping stream from above. As a result of this measure, the separation can be carried out in a very deliberate manner in a specific region of the overlapping stream, in which the remaining overlapping stream remains unaffected.

With the foregoing and other objects in view there is further provided, in accordance with the invention, an apparatus for guiding sheets to a sheet processing machine. The apparatus contains a lifting device for reducing an adhesion force between two sheets following one another in an overlapping stream by lifting a sheet trailing edge of a first sheet. The lifting device is disposed above the overlapping stream. A front edge alignment device is provided and, the lifting device is disposed at a distance of a sheet length to be processed from the front edge alignment device. The lifting device can be adjusted in a sheet transport direction to a sheet format to be processed. The lifting device has at least one nozzle, and the nozzle is aligned tangentially with respect to a surface of the overlapping stream and is aimed in a sheet transport direction. The nozzle is formed as a blowing/suction nozzle and can be acted on with blown air. The nozzle can be formed as a suction gripper and can be acted on with a vacuum. Preferably, the lifting device has a free jet nozzle in addition to the nozzle, the free jet nozzle is aimed at the overlapping sheet stream obliquely from above in a sheet transport direction. The nozzle and/or the free jet nozzle can be activated at a cycle rate of the sheet processing machine.

By forming the lifting apparatus as a blowing/suction nozzle, the sheet trailing edge can even already be lifted when the latter is still moving and not just only once it has struck the front guides. Lateral alignment of the sheet can continue to be carried out without hindrance.

In one advantageous development, the additional free jet nozzle blows blown air between the lifted sheet trailing edge of the first sheet and the upper side of the following sheet.

A ledge on the underside of the sheet lifting apparatus is disposed at a short distance behind the blowing/suction nozzle and assists the separation of the sheets if the second sheet is lifted as well by adhesion forces.

A linear guide disposed in the transport direction permits the adjustment of the apparatus according to the invention to the sheet format to be processed.

A printing press is preferably formed with a sheet stack feeder, a first lifting apparatus for forming an overlapping stream and disposed adjacent the sheet stack feeder, and a second lifting apparatus disposed above the overlapping stream.

Other features which are considered as characteristic for the invention are set forth in the appended claims.

Although the invention is illustrated and described herein as embodied in a method and an apparatus for guiding sheets to a sheet processing machine, in particular a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
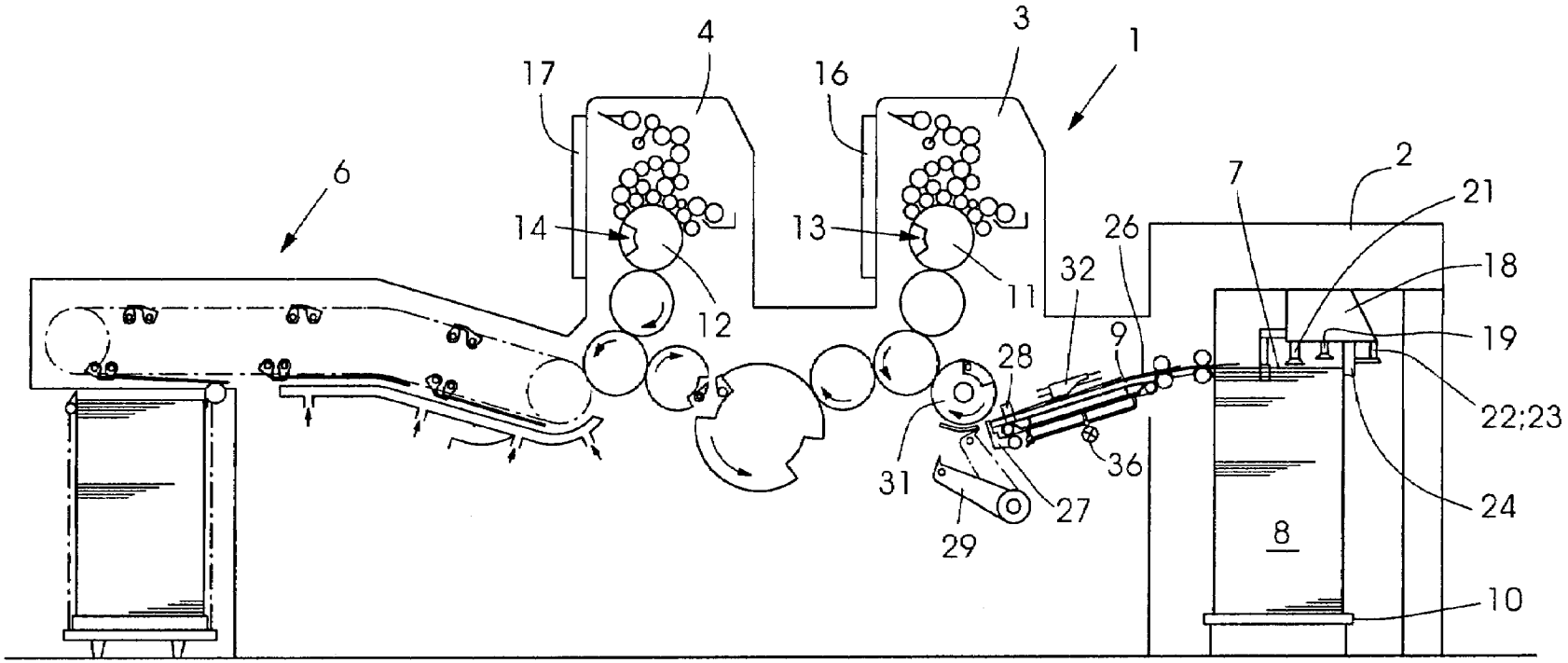
FIG. 1 is a diagrammatic, side-elevational view of a sheet processing printing press.

Referring now to the figures of the drawing in detail and first, particularly, to FIG. 1 thereof, there is shown a machine that processes sheets 7, for example a printing press 1, and has a feeder 2, at least one printing unit 3 and/or 4 and a deliverer 6. The sheets 7 are taken from a sheet stack 8 and, separated or overlapped, are fed over a feed table 9 to the printing units 3 and 4, the latter each containing, in a known manner, a plate cylinder 11; 12. The plate cylinders 11 and 12 each have an apparatus 13, 14 for fastening flexible printing plates. Furthermore, each plate cylinder 11; 12 is assigned an apparatus 16; 17 for semiautomatic or fully automatic printing plate change.

The sheet stack 8 rests on a stack plate 10 which can be raised under control. The removal of the sheets 7 is carried out from the upper side of the sheet stack 8 by what is known as a suction head 18 which, inter alia, has a number of lifting and dragging suckers 19, 21 for separating the sheets 7. Furthermore, blowing devices 22 for loosening the upper layers of sheets and sensing elements 23 for stack tracking are provided. In order to align the sheet stack 8, in particular the upper sheets 7 of the sheet stack 8, a number of lateral and rear stops are provided.

The feed table 9 has at least one transport belt 26, preferably a suction belt, to transport the sheets or the sheet stream to front aligning guides, also known as front guides 27. A lateral alignment apparatus 28 is likewise disposed in a front region of the feed table 9. The aligned sheet 7 is gripped by a pregripper 29 and fed to a feed drum 31.

Figure 2:
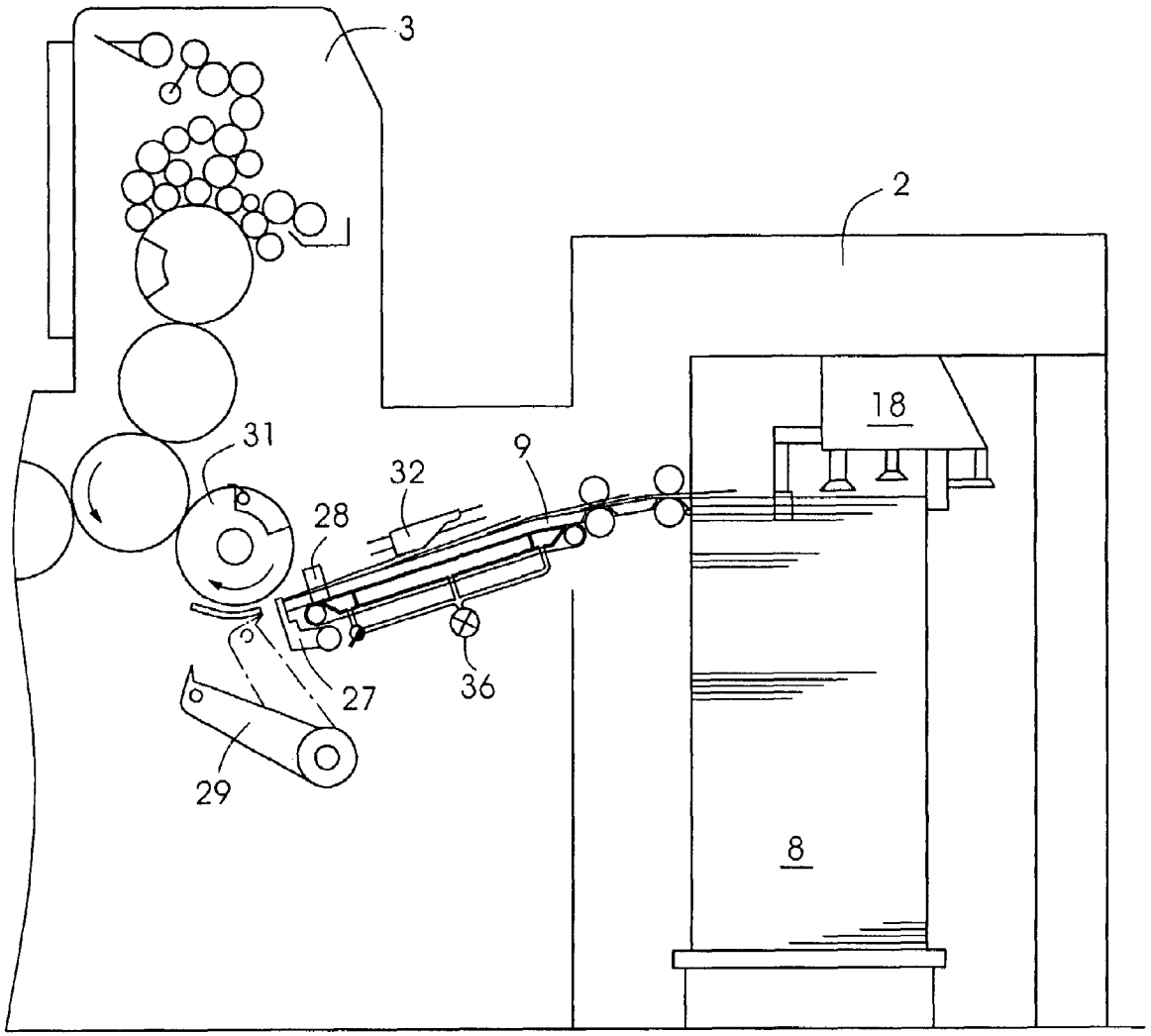
FIG. 2 is a side-elevational view of a feed table of a sheet feeder.
Figure 3:
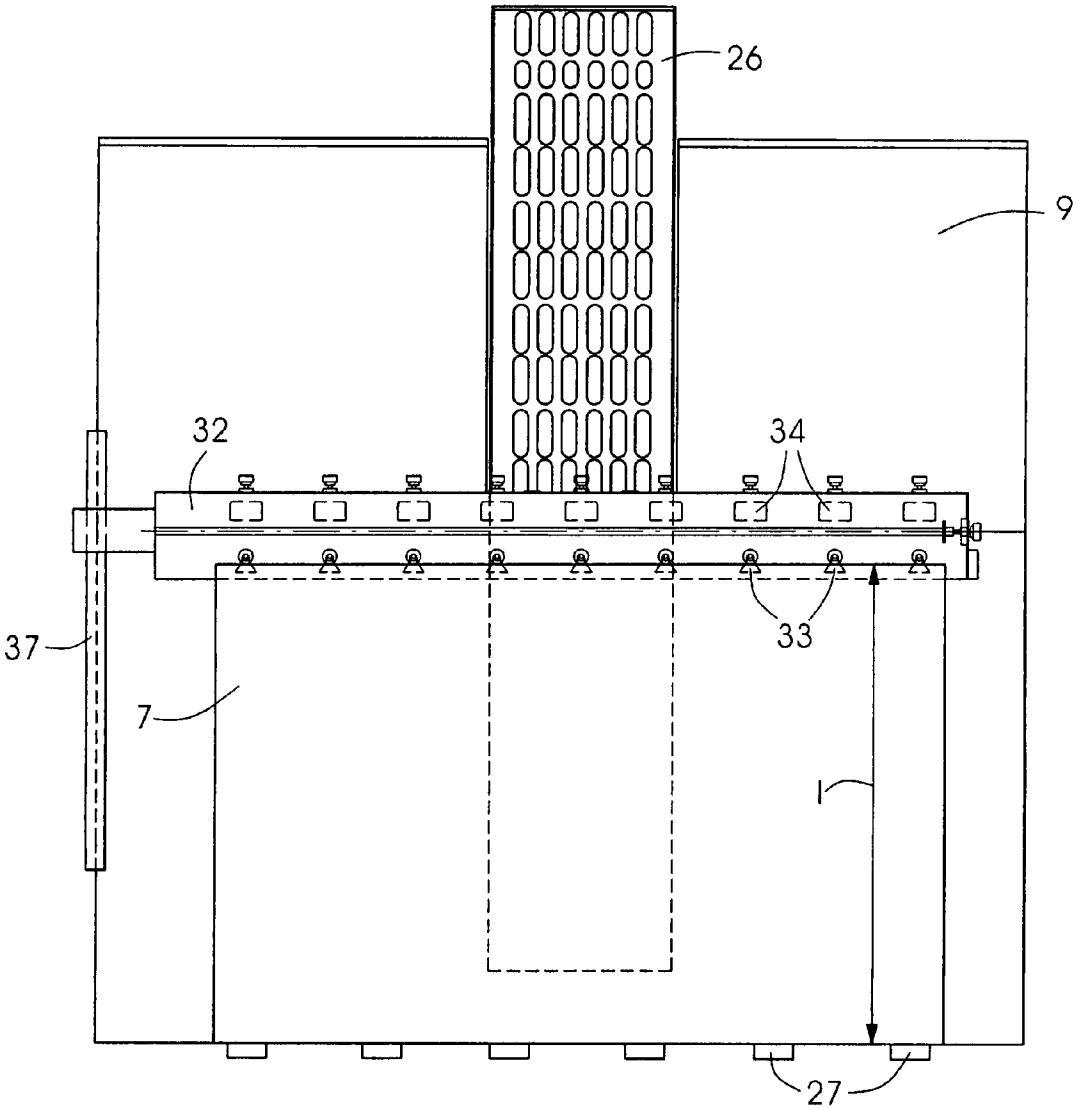
FIG. 3 is a plan view of a lifting apparatus disposed above a feed plane according to the invention.
Figure 4:
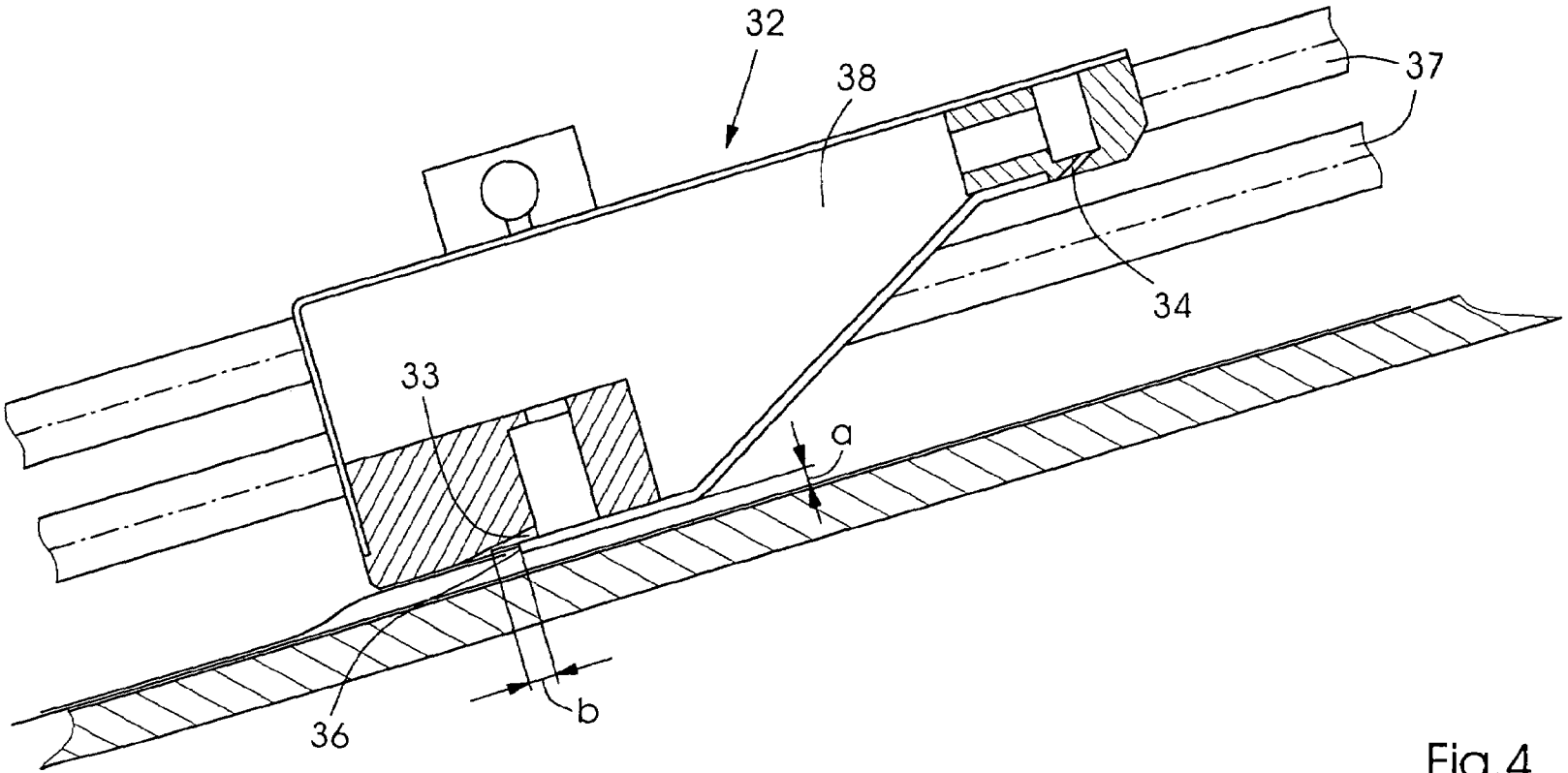
FIG. 4 is side-elevational view of the lifting apparatus according to the invention.

A sheet lifting apparatus 32 is disposed above the overlapped sheet stream, approximately at a distance of a format length l from the front guides 27 (see FIG. 2). The sheet lifting apparatus 32 has substantially at least one blowing/suction nozzle 33 (see FIG. 4), preferably a number of blowing/suction nozzles 33 disposed distributed beside one another over the format width of the sheet stream. The blowing/suction nozzle 33 is aligned in such a way that a blown air jet aimed in the sheet transport direction is blown out substantially tangentially over the sheet stream at a short distance a (e.g. a=about 4 millimeters). By using what is known as the "aerodynamic paradox" effect, the sheet trailing edge is lifted and thus separated from the following sheet lying underneath.

In order to assist this separating effect, at least one, preferably a number of free jet nozzles 34 disposed beside one another are provided, whose blown air jet is aimed at the sheet trailing edge obliquely from above, so that the blown air jet can enter between the underside of the first sheet and the upper side of the following, lower sheet. All the free jet nozzles 34 are disposed such that they can be adjusted transversely with respect to the sheet transport direction and can be locked at a desired position. A small ledge 36 on the underside of the lifting apparatus 32 is located, as viewed in the sheet transport direction, at a short distance b (e.g. b=about 2 millimeters) in front of the blowing/suction nozzle 33. This measure benefits the separation of two successive sheets if the second sheet should be lifted as well, for an example as a result of static electricity, adhesion force.

In order to be able to adjust the lifting apparatus 32 to the sheet format length l to be processed, a linear guide 37, on which the lifting apparatus 32 is mounted such that it can be displaced, is provided on one side of the feed table 9.

An air supply duct 38 in the interior of the lifting apparatus 32 supplies the blowing/suction nozzle 33 and the free jet nozzle 34 with blown air from a blown air source, not illustrated. The blown air streams out continuously. In a further development, provision is made to cycle the blown air at the cycle rate of the sheet-processing machine. For this purpose, a rotary valve or electromagnetically driven valves is or are used.

Alternatively, it is proposed to form the nozzle 33 as a suction gripper and to act on it with a vacuum instead of with blown air, while the free jet nozzle 34 continues to be supplied with blown air.

The sheets 7 are separated from the sheet stack 8 by the suction head 18 and fed to the front guides 27 in overlapped form by the transport belt 26. By use of the sheet lifting apparatus 32 disposed above the sheet stream at the sheet length distance 1 in front of the front guides 27, the sheet trailing edge of the respective first sheet 7 of the sheet stream is lifted and blown under by the free air jet from the free jet nozzle 34.

The sheet trailing edge is preferably lifted as soon as the sheet leading edge has reached the front guides. As a result of this measure, the first sheet can thereupon or simultaneously be aligned laterally without carrying the second sheet along with it.

I claim:

1. A method for guiding sheets to a sheet processing machine, which comprises the step of:

generating an overlapping stream of sheets guided over a table in a sheet transport direction;

reducing an adhesion force between two sheets following one another in the overlapping stream by lifting a sheet trailing edge of a first sheet with a blown air jet from a first nozzle aimed in the sheet transport direction blown out substantially tangentially over the first sheet; and lifting the sheet trailing edge of the first sheet by blowing under the sheet from behind the sheet with a second nozzle spaced apart from the first nozzle in the transport direction.

2. The method according to claim 1, which further comprises aligning the first sheet in the sheet transport direction before the sheet trailing edge of the first sheet is lifted.

3. The method according to claim 2, which further comprises aligning the first sheet laterally at a same time as the sheet trailing edge of the first sheet is lifted.

4. The method according to claim 2, which further comprises aligning the first sheet laterally after the sheet trailing edge of the first sheet has been lifted.

5. An apparatus for guiding sheets to a sheet processing machine, the apparatus comprising:

a transport belt for transporting the sheets; and a lifting device for reducing an adhesion force between two sheets following one another in an overlapping stream on said transport belt by lifting a sheet trailing edge of a first sheet, said lifting device disposed above the first sheet of the overlapping stream, said lifting device including at least one nozzle with an air jet aimed in a sheet transport direction substantially tangentially over the first sheet of the overlapping stream, and said lifting device having a free jet nozzle in addition to said nozzle, said free jet nozzle being disposed upstream of said at least one nozzle in the sheet transport direction, and said free jet nozzle being aimed at the overlapping sheet stream obliquely from above in the sheet transport direction.

6. The apparatus according to claim 5, further comprising a front edge alignment device, said lifting device being disposed at a distance of a sheet length to be processed from said front edge alignment device.

7. The apparatus according to claim 6, wherein said lifting device can be adjusted in the sheet transport direction to a sheet format to be processed.

8. The apparatus according to claim 5, wherein said nozzle is formed as a blowing/suction nozzle and can be acted on with blown air.

9. The apparatus according to claim 8, wherein said nozzle is formed as a suction gripper and can be acted on with a vacuum.

10. The apparatus according to claim 5, wherein at least one of said nozzle and said free jet nozzle can be activated at a cycle rate of the sheet processing machine.

11. A printing press, comprising:

a sheet stack feeder;

a first lifting apparatus for forming an overlapping stream and disposed adjacent said sheet stack feeder;

a transport belt for transporting the sheets; and a second lifting apparatus for reducing an adhesion force between two sheets following one another in an overlapping stream on said transport belt by lifting a sheet trailing edge of a first sheet, said second lifting apparatus disposed above the first sheet of the overlapping stream and downstream of said first lifting apparatus in a sheet transport direction, said second lifting apparatus including at least one nozzle with an air jet aimed in the sheet transport direction substantially tangentially over the first sheet of the overlapping stream, and said second lifting apparatus having a free jet nozzle in addition to said nozzle, said free jet nozzle being disposed upstream of said at least one nozzle in the sheet transport direction, and said free jet nozzle being aimed at the overlapping sheet stream obliquely from above in the sheet transport direction.

12. The apparatus according to claim 5, wherein said nozzle and said free jet nozzle are spaced apart from each other in the sheet transport direction.

* * * * *